US005137040A

United States Patent [19]

Iosilevich et al.

[11] Patent Number: 5,137,040

[45] Date of Patent: Aug. 11, 1992

[54] MAKEUP APPLICATOR

[76] Inventors: Ilya Iosilevich; Irina Iosilevich, both of 2320 N.E. 7th St., Hallandale, Fla. 33009

[21] Appl. No.: 636,881

[22] Filed: Jan. 2, 1991

[51] Int. Cl.[5] ..... A45D 40/26

[52] U.S. Cl. ..... 132/320; 132/218; 132/319

[58] Field of Search ..... 132/200, 216, 218, 317, 132/319, 320, 333

[56] References Cited

U.S. PATENT DOCUMENTS

| | | | |
|---|---|---|---|
| 1,107,977 | 8/1914 | Miller | 132/320 |
| 1,746,877 | 2/1930 | Tompkins | 132/333 |
| 2,175,133 | 10/1939 | Singleton | 132/317 |
| 2,917,058 | 12/1959 | Ferrar | 132/216 |
| 3,266,500 | 8/1966 | Weld | 132/320 |
| 3,472,242 | 10/1969 | Demner | 132/333 |
| 3,568,684 | 3/1971 | Reece | 132/333 |
| 4,748,976 | 6/1988 | Cali | 132/319 |
| 4,887,994 | 12/1989 | Bedford | 132/317 |
| 4,936,325 | 6/1990 | Davis | 132/216 |

FOREIGN PATENT DOCUMENTS

| | | | |
|---|---|---|---|
| 333604 | 9/1989 | European Pat. Off. | 401/88 |

*Primary Examiner*—John J. Wilson
*Assistant Examiner*—Frank A. LaViola
*Attorney, Agent, or Firm*—Malloy, Downey & Malloy

[57] ABSTRACT

An applicator pad formed of a cosmetic sponge material for use in applying makeup to a person's upper eyelid area. A cosmetic substance such as a pigmented gel, cream, liquid powder, or dry powder is impregnated within an inner surface of the applicator being disposed in an array of colors or tones corresponding with a preferred application of makeup in accordance with a particular user's facial features and skin tone. The applicator is adapted to be placed against the upper eyelid area with the inner surface having the impregnated cosmetic substance contacting the user's skin whereupon application of pressure to an opposite outer surface of the applicator and removal thereof from the upper eyelid area serves to apply the prearranged array of makeup to the upper eyelid area as desired.

14 Claims, 1 Drawing Sheet

MAKEUP APPLICATOR

BACKGROUND OF THE INVENTION

1. Field of the Invention

The present invention relates generally to applicators for the application of makeup to a person's facial areas. More specifically, the present invention is directed to an applicator having a prearranged array of makeup thereon for transfer and application to the user's upper eyelid area.

2. Description of the Related Art

The application of various types of cosmetic substances to one's facial areas is an art in and of itself requiring different colors or tones to be used as well as varying techniques depending upon the individual's facial features, hair color and skin tone. For instance, a person with fair skin and relatively thin eyebrows would require a completely different makeup application around the eyes than a person having darker skin with relatively thicker eyebrows. When applying makeup to the upper eyelid area, including the eyelid and the area between the eyelid and the eyebrow, the particular person's skin tone must be considered in order to select the proper array of makeup colors which best compliment the person's appearance. Additionally, the shape of the eye and upper eyelid area will determine how various shades and colors are applied so as to emphasize certain features and de-emphasize others. A further consideration taken into account when applying makeup to the upper eyelid area is the thickness of the eyebrows and eyelashes as well as the length of the eyelashes.

Presently, the application of eye shadow and other cosmetic substances such as pigmented gels, dry or liquid powders, and other light creams to the upper eyelid area is achieved using an applicating stick or swab having an applicator pad on the end. Using this type of applicator, a person is required to essentially paint the makeup on the skin by first coating the applicator tip with a particular makeup to be applied and then passing the applicator tip across the skin to apply the cosmetic substance thereto. Accordingly, if it is desired to use an array of colors or shades of makeup, this method of application using the commonly known applicator can be quite tedious and time consuming. Moreover, if a person is not skilled in the make-over art, it is generally difficult to apply the makeup in a manner which best compliments the individual person's facial features such as complexion, eye color, hair color and facial structure.

Accordingly, there is a need in the present makeup art for a makeup applicator adapted to apply a prearranged array of makeup to a person's upper eyelid area in accordance with a particular individual's facial features.

It is, therefore, an object of the present invention to provide a makeup applicator for applying a prearranged array of makeup to a person's upper eyelid area in accordance with that person's particular makeup needs.

It is a further object of the present invention to provide a makeup applicator and method of application which is easy and less time consuming than the present methods of makeup application.

It is another object of the present invention to provide a makeup applicator which is inexpensive to manufacture and disposable after use.

It is still further a object of the present invention to provide a makeup applicator which includes a prearranged array of makeup substance impregnated within a surface thereof wherein the prearranged array of makeup substance is readily transferable to a person's upper eyelid area.

It is yet another object of the present invention to provide a makeup applicator which can be used by a person with little or no makeup application skills, wherein a prearranged array of makeup can be easily applied to a person's upper eyelid area in a manner which best compliments that person's particular facial features.

These and other further objects and features of the present invention are apparent in the following disclosure including the detailed description, drawings and claims.

SUMMARY OF THE INVENTION

The present invention is directed towards a makeup applicator for use in applying makeup to a person's upper eyelid area More specifically, the makeup applicator of the present invention is adapted to apply a prearranged array of makeup substances to the upper eyelid area including but not limited to pigmented gels, liquid and dry powders, cream powders, and other types of cosmetic creams.

The makeup applicator of the present invention generally comprises a relatively flat applicator formed of a cosmetic sponge material, wherein the applicator is specifically shaped and configured to conform with the shape of the upper eyelid area including the area generally extending from just below the eyebrows to the edge of the upper eyelid. A cosmetic substance such as a pigmented gel, liquid powder or other substance is impregnated within an inner surface of the applicator in such a manner so as to be readily transferable directly onto the skin of the upper eyelid area upon pressing the inner surface of the applicator against the upper eyelid area and then removing the applicator. This is generally accomplished by placing the applicator over the upper eyelid area, while keeping the upper eyelid closed, and then while maintaining contact of the inner surface with the skin of the upper eyelid area, pressure is applied across an entire outer surface of the applicator by rubbing one's fingers therealong so as to effectively transfer the impregnated cosmetic substance onto the skin. After removing the applicator, the makeup is left applied to the upper eyelid area in accordance with a preferred array of makeup application.

Preferably, a left applicator and a right applicator are used with each being specifically shaped and configured for either a left eyelid area or a right eyelid area. The pair of applicator's can be neatly packaged in a transparent envelope structure having segregated portions for the separate left and right applicators. The package may further include a tag, attached card or the like for the purposes of placing advertising indicia and instructional material thereon.

The invention accordingly comprises the features of construction, combination of elements and arrangements of parts which will be exemplified in the construction hereinafter set forth and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 2:
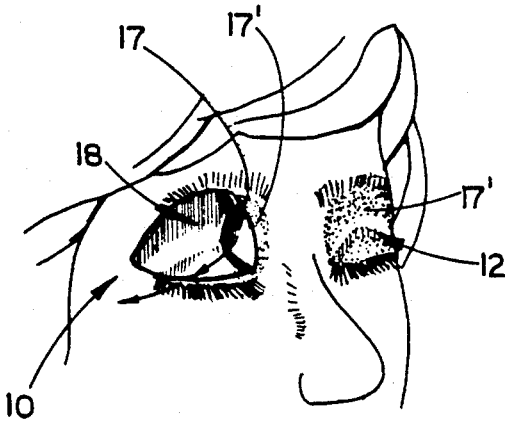
FIG. 2 is a perspective view illustrating the applicator of the present invention as normally used to apply makeup to an upper eyelid area of a user.
Figure 3:
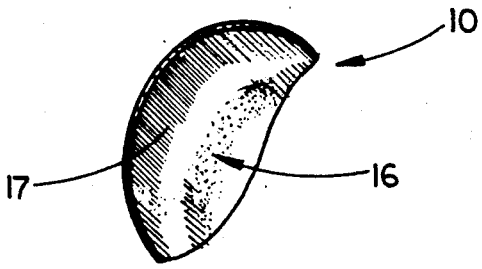
FIG. 3 is a perspective view of a preferred embodiment of the makeup applicator of the present invention.

As best shown in FIGS. 2 and 3, the present invention is directed towards a disposable makeup applicator, generally indicated as 10, for use in applying makeup to an upper eyelid area 12 as seen in FIG. 2.

The applicator 10 includes an inner surface 16 which is impregnated with a cosmetic substance 17 such as, but not limited to, pigmented gels, liquid, dry, or cream powders or other cosmetic creams. The cosmetic substance 17 is generally disposed in a particular array, as illustrated by the various shading in FIG. 3, in accordance with a desired makeup effect. Referring to FIGS. 8 through 11, it is seen that the substance 17 is absorbed into only a portion of the thickness of the applicator 10.

Referring to FIG. 2, the application of makeup to the upper eyelid area using the applicator of the present invention is illustrated wherein the applicator is placed over the upper eyelid area with the inner surface 16 engaging the skin. By applying pressure over an outer surface 18 of the applicator 10, the substance 17 is at least partially transferred to the skin of the upper eyelid area 12 in accordance with the prearranged array as originally impregnated within the inner surface of the applicator. Once removing the applicator 10 from the upper eyelid area, a preferred application of makeup 17' is seen on the upper eyelid 12. Because the prearranged array of makeup substance 17 on the inner surface of the applicator 10 is transferred directly onto the skin of the upper eyelid area 12, a correspondingly matching array of makeup 17' is achieved on the upper eyelid area in accordance with a desired effect.

Figure 4:
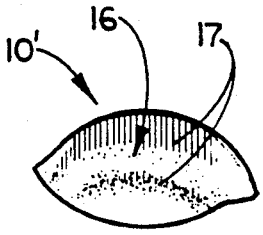
FIG. 4 is a plan view of an inner surface of an applicator for use on a left upper eyelid area illustrating a cosmetic substance impregnated therein.
Figure 5:
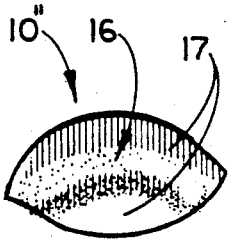
FIG. 5 is a plan view of an applicator for use on a right upper eyelid area illustrating a cosmetic substance impregnated therein.
Figure 8:
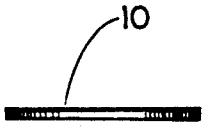
FIG. 8 is a side elevation of the applicator in FIG. 3.
Figure 9:
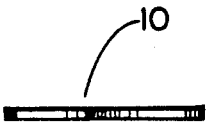
FIG. 9 is an opposite side elevation of the applicator in FIG. 3
Figure 6:
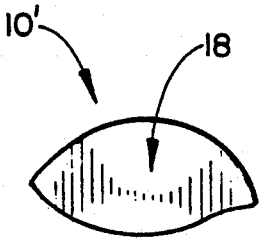
FIG. 6 is a plan view of an outer surface of the applicator of FIG. 4.
Figure 7:
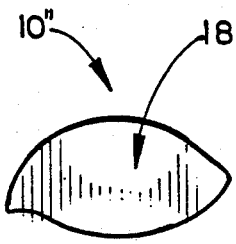
FIG. 7 is a plan view of an outer surface of the applicator of FIG. 5.
Figure 10:
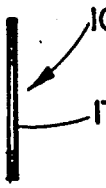
FIG. 10 is an end elevational view of the applicator in FIG. 3.
Figure 11:
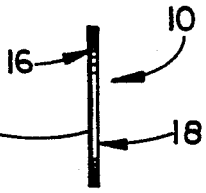
FIG. 11 is a opposite end elevational view of the applicator in FIG. 3.

As seen in FIGS. 4 through 7, the preferred embodiment of the present invention includes separate applicators for the left eyelid area and the right eyelid area wherein each applicator is specifically shaped and configured to correspond with the particular shape and configuration of either the left eyelid area or the right eyelid area. FIGS. 4 and 6 illustrate a left applicator 10' for applying makeup to the left eyelid area, and FIGS. 5 and 7 illustrate a right applicator 10" for applying makeup to the right eyelid area. As seen in FIGS. 4 and 5, the makeup substance 17 is arranged for particular application to either the left eyelid area or the right eyelid area so as to achieve the desired makeup effects.

Figure 1:
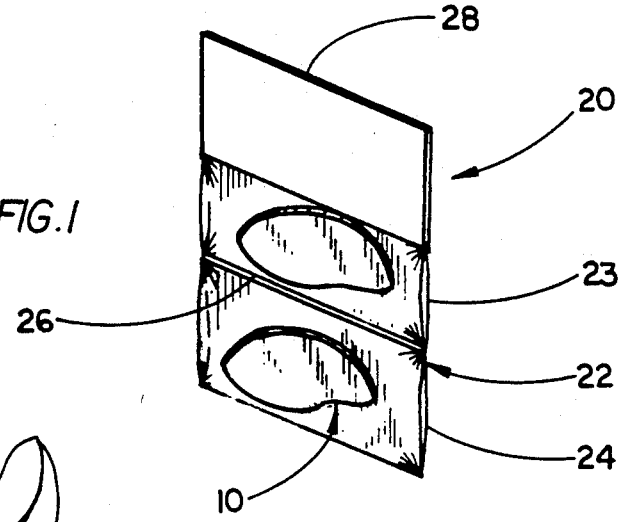
FIG. 1 is a perspective view illustrating left and right applicator of the present invention contained within a preferred packaging.

The preferred embodiment of the present invention further includes a package 20, as seen in FIG. 1, for packaging the left and right makeup applicators 10' and 10". The package 20 preferably includes an envelope structure 22 made of a transparent material so that the colors of the cosmetic substance 17 impregnated within the inner surface of the applicators can be easily viewed. The envelope structure 22 preferably includes segregated portions including an upper portion 23 and a lower portion 24 for segregated containment of the left and right applicators. The upper and lower portions 23 and 24 are preferably divided by a seam 26 extending across the width of the envelope structure 22. A tag or card 28 is attached to an upper end of the envelope structure 22 in sealing and closing relation therewith, the tag 28 being useful for placing advertising indicia and other instructional material thereon.

While the instant invention has been shown and described in what is considered to be a practical and preferred embodiment, it is recognized that departures may be made within the spirit and scope of this invention which is, therefore, not to be limited except as set forth in the claims hereinafter and within the doctrine of equivalents.

Now that the invention has been described,

What is claimed is:

1. A device for applying makeup to a person's upper eyelid area, comprising:
   - a substantially flat applicator formed of a resilient, substantially absorbent material and including an outer surface and an inner surface,
   - said applicator being specifically structured and configured so as to conform with a shape of the upper eyelid area when said inner surface is placed in confronting, overlying engagement with an exposed skin of the upper eyelid area,
   - said inner surface impregnated with a predetermined desired array of cosmetic substance of varying shades and colors,
   - said inner surface designed to be placed against the exposed skin of the upper eyelid,
   - said outer surface of said applicator including a liquid impervious outer coating adapted to prevent the cosmetic substance from passing therethrough, and
   - whereby application of the cosmetic substance is accomplished by applying pressure to said outer surface when said inner surface is disposed in direct contact with the exposed skin of the upper eyelid and thereafter removing said applicator, resulting in at least one partial transfer of the cosmetic substance to the exposed skin of the upper eyelid.

2. A device as in claim 1 wherein said applicator is formed of a cosmetic sponge material adapted to substantially absorb and readily transfer the cosmetic substance to said exposed skin of the upper eyelid area.

3. A device as in claim 2 wherein said applicator is specifically shaped and configured to conform with a corresponding configuration of either a left or right upper eyelid area.

4. A device as in claim 3 wherein said outer surface of said applicator pad includes indicia thereon to indicate use for either a left or a right eyelid.

5. A device as in claim 4 wherein said cosmetic substance impregnated in said inner surface includes an array of colors corresponding with a preferred makeup application in accordance with a desired effect to be achieved thereby.

6. A device as in claim 5 wherein said cosmetic substance includes a liquid powder.

7. A device as in claim 5 wherein said cosmetic substance includes a dry powder.

8. A device as in claim 5 wherein said cosmetic substance includes a cream powder.

9. A device as in claim 5 wherein said cosmetic substance includes a pigmented gel.

10. A device as in claim 5 wherein said cosmetic substance includes a cosmetic pigmented cream.

11. A device as in claim 5 further including package means for containing a pair of said applicators including a left eyelid applicator and a right eyelid applicator.

12. A device as in claim 11 wherein said package means comprises an envelope structure formed of a transparent material and including segregated upper and lower portions for segregated containment of said left and right eyelid applicators.

13. A device as in claim 12 wherein said package means further includes a tag portion attached to an open top of said envelope structure in sealing relation thereto, said tag portion being adapted for placement of advertisement and instructional indicia thereon.

14. A method of applying makeup to a person's upper eyelid area using the device as set forth in claim 1, the method comprising the steps of:

placing a cosmetic foam applicator over the upper eyelid area such that an inner surface impregnated with a cosmetic substance engages exposed skin on the upper eyelid area, applying pressure across an outer surface of the applicator, simultaneously transferring the impregnated cosmetic substance from said inner surface to the exposed skin of the upper eyelid area, and removing the applicator from the upper eyelid area to reveal a preferred application of makeup thereto.

* * * * *